US008311438B2

(12) United States Patent
Onuma et al.

(10) Patent No.: US 8,311,438 B2
(45) Date of Patent: Nov. 13, 2012

(54) INTERLOCK DEVICE AND IMAGE FORMING APPARATUS INCORPORATING SAME

(75) Inventors: Sei Onuma, Ikeda (JP); Nobuhiko Kita, Suita (JP); Haruo Hashimoto, Ikeda (JP); Masafumi Takahira, Toyonaka (JP); Kaoru Tada, Toyonaka (JP); Genta Hagiwara, Ikeda (JP); Tatsuo Fukushima, Toyonaka (JP)

(73) Assignee: Ricoh Company, Ltd., Tokyo (JP)

( * ) Notice: Subject to any disclaimer, the term of this patent is extended or adjusted under 35 U.S.C. 154(b) by 430 days.

(21) Appl. No.: 12/725,788

(22) Filed: Mar. 17, 2010

(65) Prior Publication Data

US 2010/0239307 A1 Sep. 23, 2010

(30) Foreign Application Priority Data

Mar. 17, 2009 (JP) ..... 2009-063923

(51) Int. Cl.
*G03G 15/00* (2006.01)

(52) U.S. Cl. ..... 399/90; 399/88; 399/110

(58) Field of Classification Search ..... 399/90
See application file for complete search history.

(56) References Cited

U.S. PATENT DOCUMENTS

| | | | |
|---|---|---|---|
| 7,555,244 | B2 | 6/2009 | Idehara et al. |
| 7,580,653 | B2 | 8/2009 | Idehara et al. |
| 7,611,106 | B2 | 11/2009 | Kondo et al. |
| 2007/0065201 | A1 | 3/2007 | Fujiwara et al. |
| 2007/0110473 | A1 | 5/2007 | Kondo et al. |
| 2007/0246638 | A1 | 10/2007 | Idehara et al. |
| 2008/0006166 | A1 | 1/2008 | Ohkubo et al. |
| 2008/0007935 | A1 | 1/2008 | Kondo et al. |
| 2008/0050146 | A1 | 2/2008 | Kita et al. |
| 2008/0063425 | A1 | 3/2008 | Idehara et al. |
| 2008/0075502 | A1 | 3/2008 | Tada et al. |
| 2008/0226352 | A1 | 9/2008 | Tanaka et al. |
| 2008/0226358 | A1 | 9/2008 | Hanashima et al. |
| 2008/0253796 | A1 | 10/2008 | Idehara et al. |
| 2008/0279585 | A1 | 11/2008 | Furuichi et al. |
| 2008/0292356 | A1 | 11/2008 | Furuichi et al. |
| 2009/0022514 | A1 | 1/2009 | Fujiwara et al. |
| 2009/0056484 | A1 | 3/2009 | Hanashima et al. |
| 2009/0074446 | A1 | 3/2009 | Idehara et al. |
| 2009/0074456 | A1 | 3/2009 | Tada et al. |
| 2009/0080937 | A1 | 3/2009 | Kita et al. |
| 2009/0110432 | A1 | 4/2009 | Idehara et al. |
| 2009/0121418 | A1 | 5/2009 | Tanaka et al. |
| 2009/0174135 | A1 | 7/2009 | Tanaka et al. |
| 2009/0285588 | A1 | 11/2009 | Furuichi et al. |
| 2009/0302521 | A1 | 12/2009 | Kondo et al. |
| 2009/0315250 | A1 | 12/2009 | Kimura et al. |

FOREIGN PATENT DOCUMENTS

| | | |
|---|---|---|
| JP | 2002-67437 | 3/2002 |
| JP | 2008-37054 | 2/2008 |
| JP | 4079588 | 2/2008 |

*Primary Examiner* — Walter L Lindsay, Jr.
*Assistant Examiner* — David Bolduc
(74) *Attorney, Agent, or Firm* — Cooper & Dunham LLP

(57) ABSTRACT

In an interlock device for turning a switch on and off in accordance with closing and opening of a plurality of covers covering a body of an electronic apparatus, one striker protrudes from each of the covers. An engagement member is provided inside the body of the electronic apparatus to move in a predetermined direction to contact and separate from the switch to turn the switch on and off. All the strikers contact the engagement member to turn on the switch when all the covers are closed. At least one of the strikers separates from the engagement member to turn off the switch when the corresponding cover is opened.

14 Claims, 7 Drawing Sheets

INTERLOCK DEVICE AND IMAGE FORMING APPARATUS INCORPORATING SAME

TECHNICAL FIELD

The present disclosure relates to an interlock device and an image forming apparatus, and more particularly, to an interlock device having a flexible design capability and an image forming apparatus including the interlock device.

BACKGROUND ART

Generally, with electronic apparatuses such as image forming apparatuses, it has become important to achieve compactness, simplification, and cost reduction. To achieve compactness, it is necessary to arrange components efficiently within a body of an electronic apparatus so that no space is wasted. However, the electronic apparatus generally includes consumables and components that need to be replaced during the lifetime of the electronic apparatus.

Accordingly, the configuration of the electronic apparatus should be designed to facilitate access to the consumables and the components by employing, for example, covers to be opened and closed by a user to remove them from the electronic apparatus. If the consumables and the components are inside the electronic apparatus and other outer components, for example, the covers, are provided outboard of the electronic apparatus, the outer components should be movable.

Generally, such electronic apparatuses include a variety of interior devices that are shielded by the covers. The interior devices may emit laser beams, electromagnetic waves, and radioactive rays, generate high-voltage electric currents, high or low temperatures, or contain harmful substances. When the covers are opened to remove the consumables and the components from the electronic apparatus, such interior devices are exposed to the user and the user is exposed to them. To address this, the interior devices are shut down electrically by an interlock device connected to a micro switch to protect the human body against injury caused by leakage of harmful substances, for example.

FIG. 1 is a perspective view of an electronic apparatus 100R including a known interlock device 10R. FIG. 2 is a schematic view of the interlock device 10R for explaining operations of the interlock device 10R. A micro switch 81 includes a switch lever 91 and a base 92. When the switch lever 91 is depressed, the switch lever 91 contacts the base 92 to turn on the micro switch 81. By contrast, when the pressing force is released, the switch lever 91 returns to its initial position to turn off the micro switch 81.

A linking mechanism used as the interlock device 10R to detect a closed state, in which two covers 2 and 4 that cover a body 1 are closed, includes an arm 6 and a lever 7. The arm 6 is provided on the body 1 and moves in a horizontal direction as shown in FIG. 2. The lever 7 rotates around a fulcrum provided at one end of the arm 6. When the two covers 2 and 4 are closed, strikers 3 and 5 protruding from the covers 2 and 4, respectively, press against the lever 7 and the arm 6, respectively. Accordingly, a leading edge of the lever 7 reaches a working point of the switch lever 91 of the micro switch 81 to turn on the micro switch 81. When either one of the two covers 2 and 4 is opened, the lever 7 leaves the working point to turn off the micro switch 81.

As another example of such interlock device, the electronic apparatus may include a power supply unit including a switch, connecting members, and operating members. The switch opens and closes a power circuit mounted on a substrate. The connecting members extend from the switch to the outside of the substrate in the front face direction of an apparatus body. The operating members are mounted on the connecting members and driven by covers that cover the apparatus body when the covers are closed. The switch is turned on via the connecting members when the plurality of operating members is pushed by the plurality of covers simultaneously. By contrast, the switch is turned off when any one of the covers is opened.

As yet another example of the interlock device, the electronic apparatus may include an interlock device that includes a lever rotatably provided inboard of a cover that covers an apparatus body, and a wire covered with a tube. One end of the wire is fixed to the lever. The wire and the tube extend to a power supply board provided at a rear part of the electronic apparatus so that another end of the wire touches an interlock switch. When the cover is closed, a protrusion provided on the cover presses against the lever. As a result, the lever is rotated to pull the wire so as to turn on the interlock switch. When the cover is opened, the wire is pulled reversely by a compression spring so as to turn off the interlock switch.

With these interlock devices that detect opening and closing of the cover, however, it is difficult to handle more than two covers simultaneously. Since the user needs to access the inner consumables and components from multiple sides of the electronic apparatus by opening a plurality of covers simultaneously, the interlock device should detect opening and closing of each of the plurality of covers. Accordingly, the interlock device may have a complex structure, resulting in a larger electronic apparatus and increased manufacturing costs.

SUMMARY

This patent specification describes an interlock device for turning a switch on and off in accordance with closing and opening of a plurality of covers covering a body of an electronic apparatus. The interlock device includes a plurality of strikers and an engagement member. One striker protrudes from each of the covers, and is insertable into the body of the electronic apparatus when the cover is closed. The engagement member is engaged by the strikers and provided inside the body of the electronic apparatus to move in a predetermined direction to contact the switch to turn on the switch and separate from the switch to turn off the switch. The engagement member includes a wire laid in a direction substantially perpendicular to an insertion direction of the strikers. The strikers contact the wire when the strikers are inserted into the body of the electronic apparatus. All the strikers contact the wire of the engagement member to turn on the switch when all the covers are closed. At least one of the strikers separates from the wire of the engagement member to turn off the switch when the corresponding cover is opened.

This patent specification further describes an image forming apparatus including the interlock device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
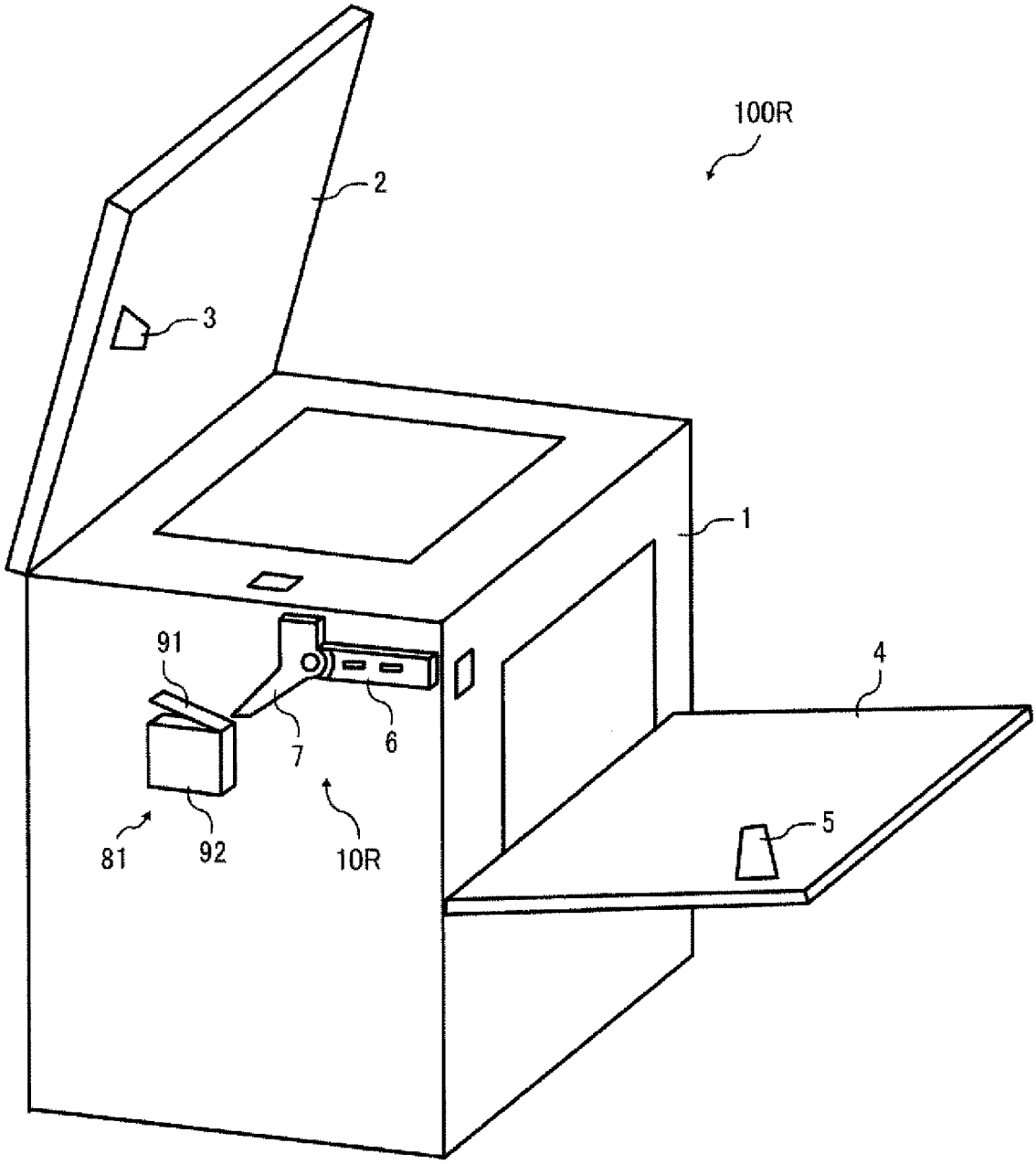
FIG. 1 RELATED ART
FIG. 1 is a perspective view of a related-art image forming apparatus.
Figure 2:
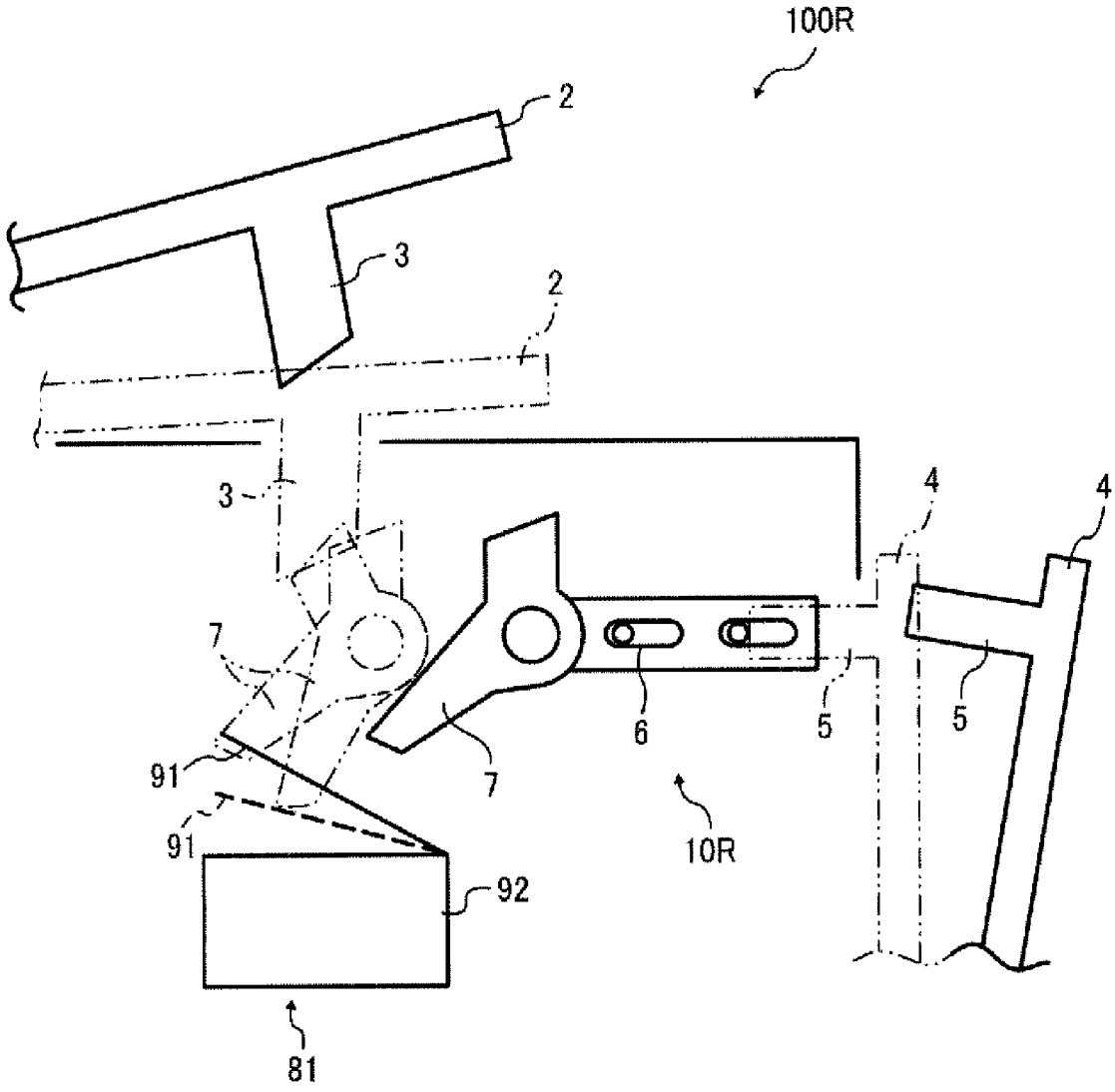
FIG. 2 RELATED ART
FIG. 2 is a schematic view of a related-art interlock device included in the image forming apparatus shown in FIG. 1.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 3A:
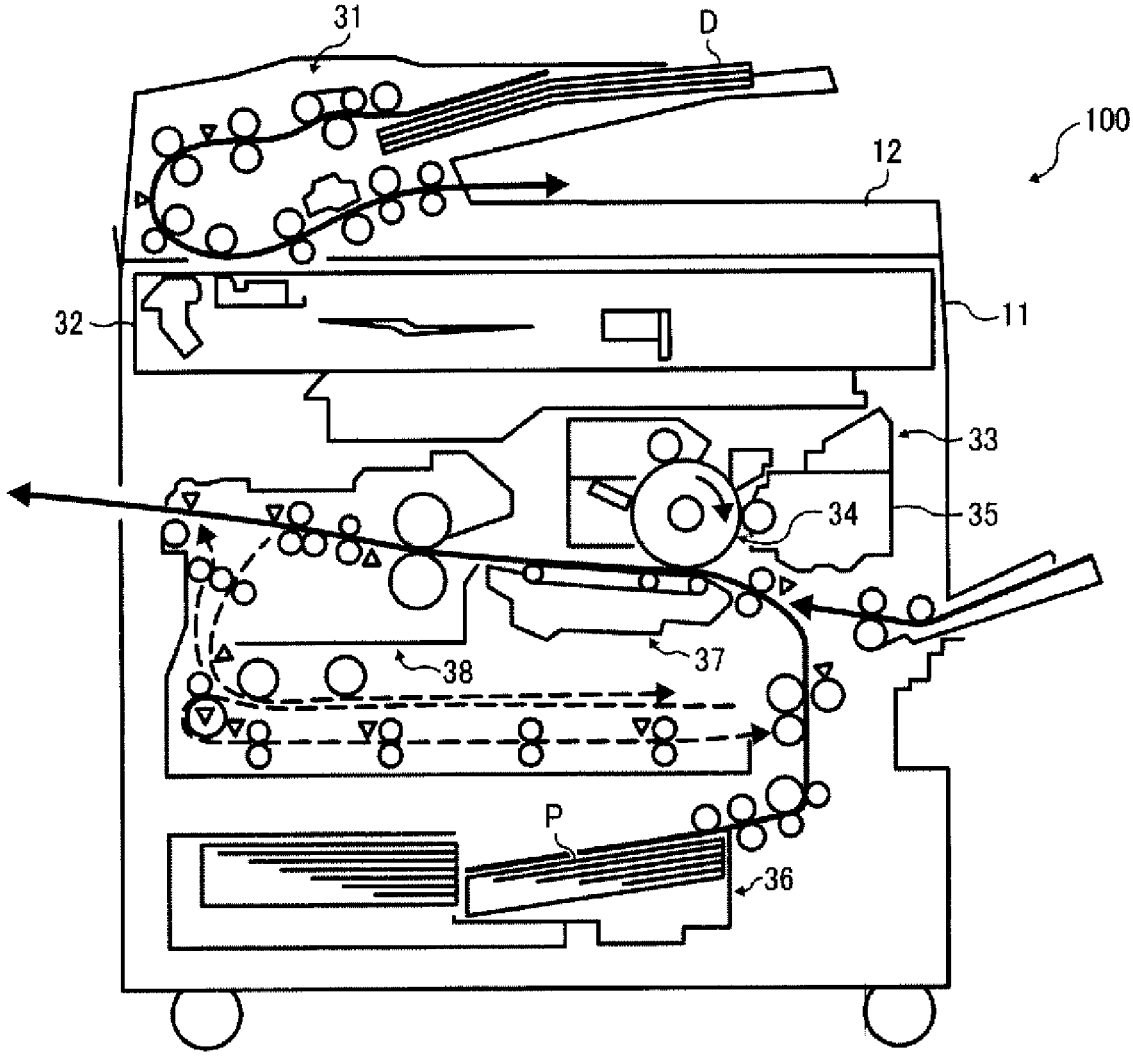
FIG. 3A is a schematic view of an image forming apparatus according to an exemplary embodiment.

Referring now to the drawings, wherein like reference numerals designate identical or corresponding parts throughout the several views, particularly to FIG. 3A, an image forming apparatus 100 according to an illustrative embodiment is described.

FIG. 3A is a schematic view of the image forming apparatus 100. As illustrated in FIG. 3A, the image forming apparatus 100 includes a body 11, a first cover 12, a document feeder 31, an optical unit 32, an image forming unit 33, a paper tray 36, a transfer device 37, and a fixing device 38. The image forming unit 33 includes a photoconductor unit 34 and a development unit 35.

As illustrated in FIG. 3A, the image forming apparatus 100 can be a copier, a facsimile machine, a printer, a multifunction printer having at least one of copying, printing, scanning, plotter, and facsimile functions, or the like. According to this exemplary embodiment, the image forming apparatus 100 includes the single image forming unit 33 to form a monochrome image on a recording medium by electrophotography. Alternatively, the image forming apparatus 100 may include at least one image forming unit 33 to form a monochrome image and/or a color image on a recording medium or may form an image by other method, for example, by an inkjet method.

In the image forming apparatus 100, the document feeder 31 is provided on the first cover 12. The optical unit 32, the image forming unit 33, the paper tray 36, the transfer device 37, and the fixing device 38 are provided inside the body 11.

The document feeder 31 loads a plurality of original documents D and feeds the original documents D one by one to the optical unit 32. The optical unit 32 optically reads an image on an original document D to generate image data, and emits light onto the photoconductor unit 34 of the image forming unit 33 according to the image data generated by the optical unit 32 or image data sent from an external device to form a latent image on the photoconductor unit 34. The development unit 35 develops the latent image with developer (e.g., toner) to make the latent image visible as a toner image.

The paper tray 36 loads a plurality of recording media P. A recording medium P is sent from the paper tray 36 to the photoconductor unit 34, and the transfer device 37 transfers the toner image formed on the photoconductor unit 34 onto the recording medium P. Thereafter, the recording medium P bearing the toner image is sent to the fixing device 38, and the fixing device 38 fixes the toner image on the recording medium P by applying heat and pressure to the toner image. Finally, the recording medium P bearing the fixed toner image is discharged from the image forming apparatus 100.

Figure 3B:
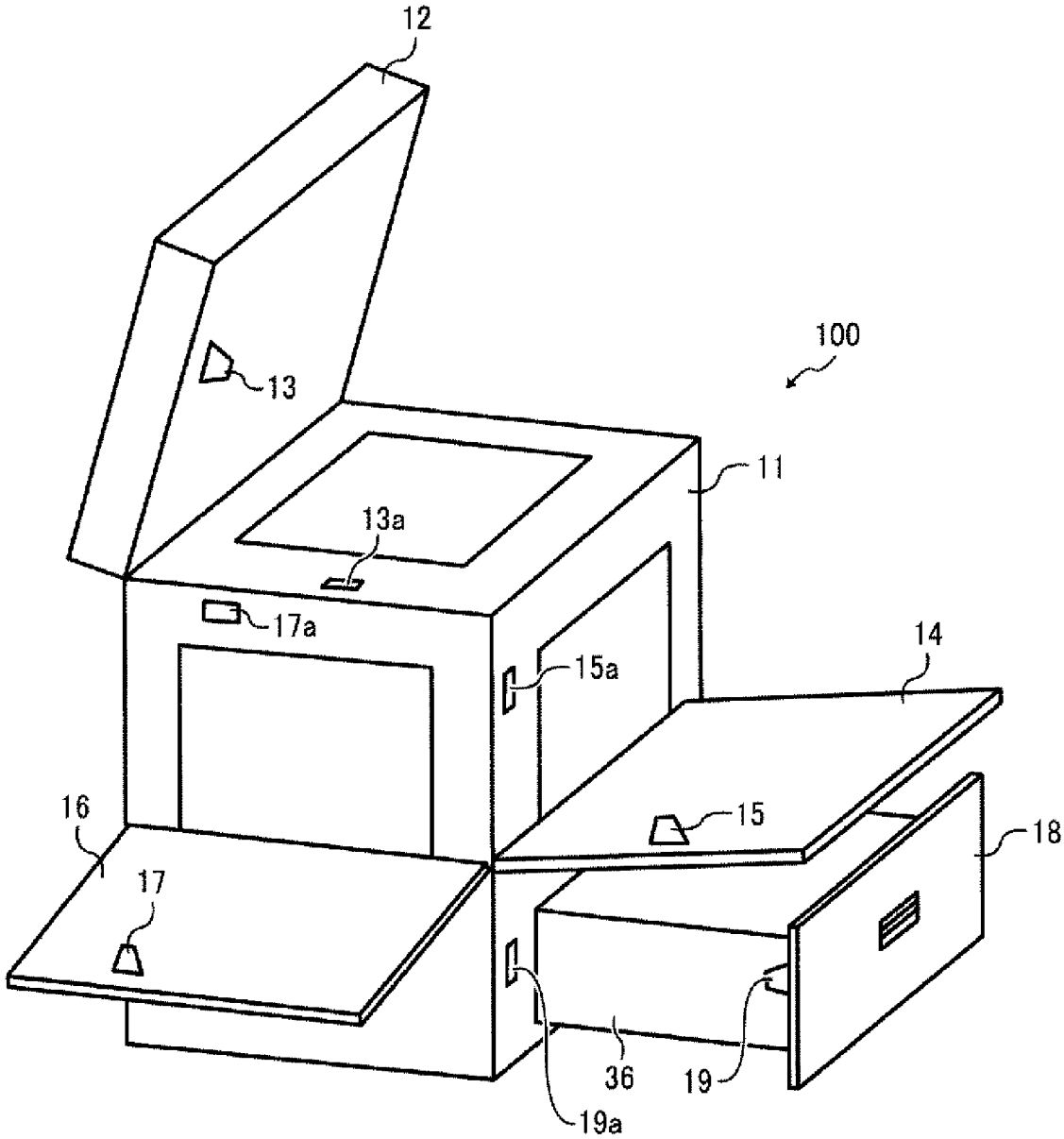
FIG. 3B is a perspective view of the image forming apparatus shown in FIG. 3A.

FIG. 3B is a perspective view of the image forming apparatus 100. As illustrated in FIG. 3B, the image forming apparatus 100 further includes strikers 13, 15, 17, and 19, a second cover 14, a third cover 16, and a fourth cover 18. The body 11 includes openings 13*a*, 15*a*, 17*a*, and 19*a*.

Figure 4:
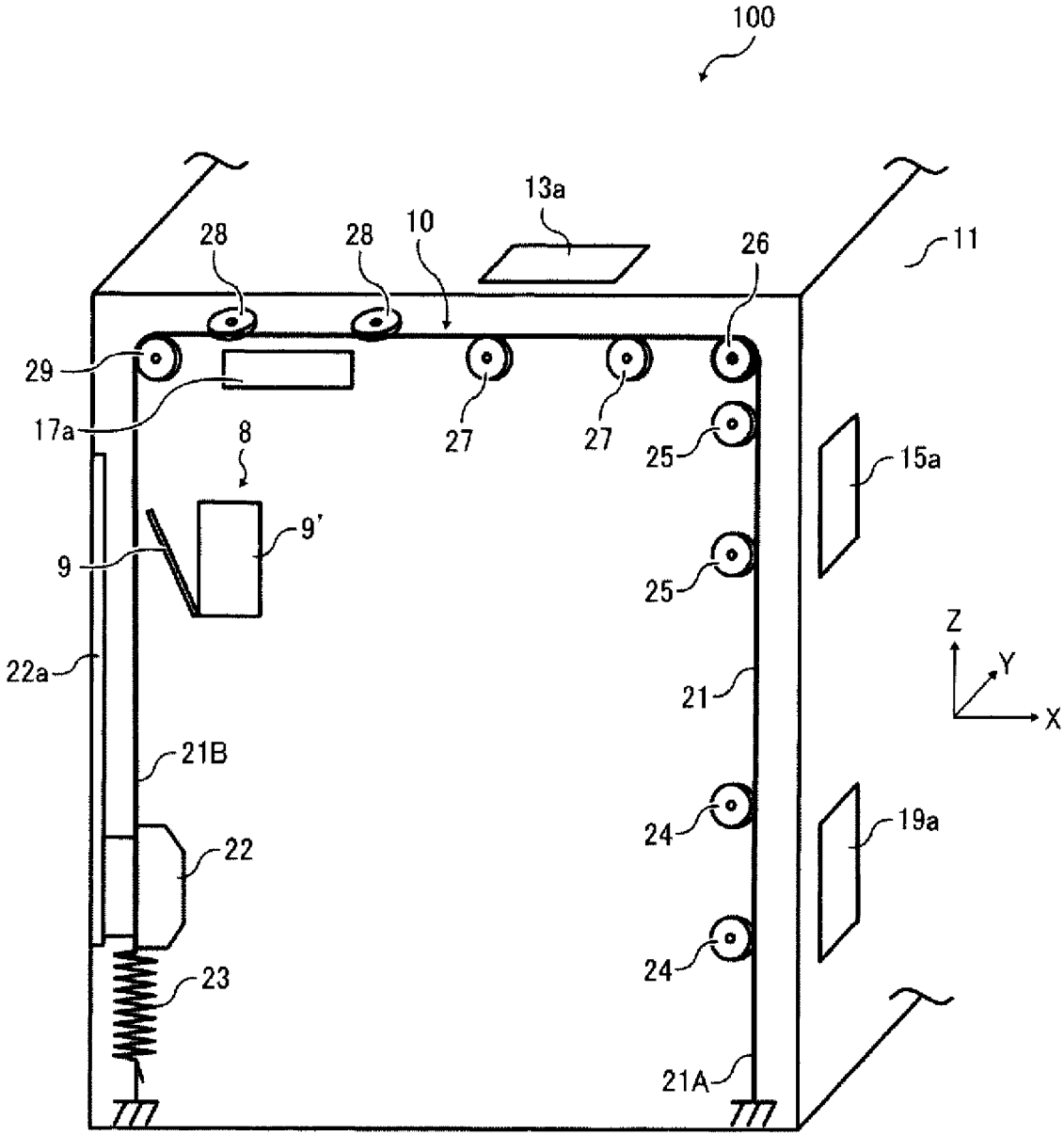
FIG. 4 is a schematic view of an interlock device included in the image forming apparatus shown in FIG. 3B when covers included in the image forming apparatus are opened.

FIG. 4 is a schematic view of the image forming apparatus 100 when the first cover 12, the second cover 14, the third cover 16, and the fourth cover 18 depicted in FIG. 3B are opened.

As illustrated in FIG. 4, the image forming apparatus 100 further includes a micro switch 8 and an interlock device 10. The micro switch 8 includes a switch lever 9 and a base 9'. The interlock device 10 includes a wire 21, an arm 22, a slide rail 22*a*, a biasing member 23, pulley pairs 24, 25, 27, and 28, and corner pulleys 26 and 29. The wire 21 includes a fixed end portion 21A and a free end portion 21B.

Figure 5:
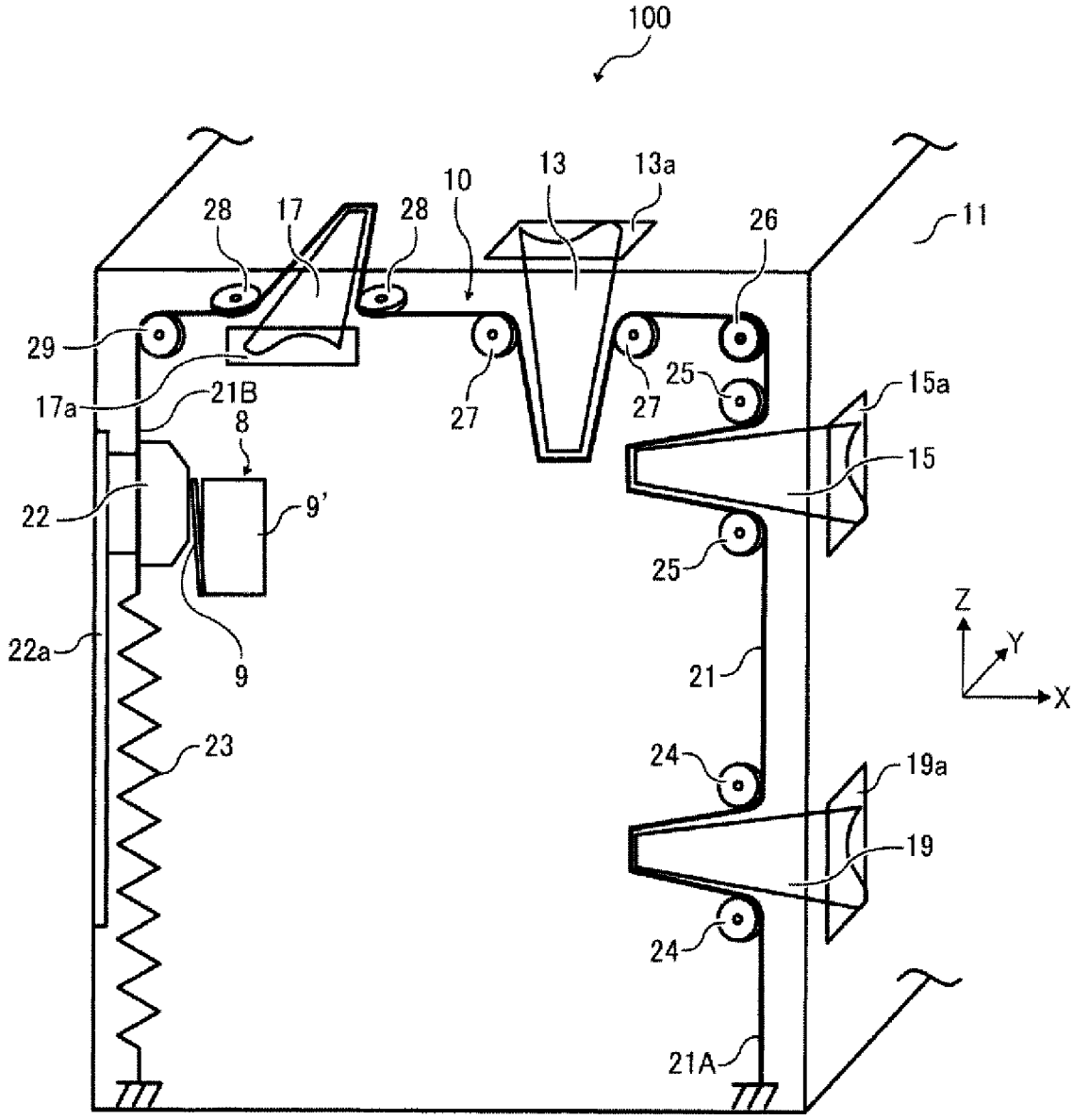
FIG. 5 is a schematic view of the interlock device shown in FIG. 4 when the covers are closed.

FIG. 5 is a schematic view of the image forming apparatus 100 when the first cover 12, the second cover 14, the third cover 16, and the fourth cover 18 depicted in FIG. 3B are closed.

As illustrated in FIG. 3B, the image forming apparatus 100 includes four openably closable covers, that is, the first cover 12, the second cover 14, the third cover 16, and the fourth cover 18. The first cover 12 is provided on a top surface of the body 11. The second cover 14 is provided on a front surface of the body 11. The third cover 16 is provided on a side surface of the body 11. The fourth cover 18 is provided at a lower front part of the body 11, and is the cover through which a user attaches and detaches the paper tray 36 to and from the image forming apparatus 100.

The openings 13*a*, 15*a*, 17*a*, and 19*a* are provided in the body 11 at positions corresponding to the strikers 13, 15, 17, and 19 protruding from the first cover 12, the second cover 14, the third cover 16, and the fourth cover 18, respectively. The strikers 13, 15, 17, and 19 enter the openings 13*a*, 15*a*, 17*a*, and 19*a*, respectively, when the first cover 12, the second cover 14, the third cover 16, and the fourth cover 18 are closed.

As illustrated in FIG. 4, the wire 21 is provided along three edges of the side surface of the body 11 adjacent to the front surface, the top surface, and a rear surface of the body 11. The flexible wire 21 has a fixed length and is not extensible. The wire 21 runs through positions adjacent to the openings 13*a*, 15*a*, 17*a*, and 19*a* in a direction substantially perpendicular to an insertion direction of the strikers 13, 15, 17, and 19 (depicted in FIG. 5) in which the strikers 13, 15, 17, and 19 are inserted into the body 11 through the openings 13*a*, 15*a*, 17*a*, and 19*a* when the first cover 12, the second cover 14, the third cover 16, and the fourth cover 18 (depicted in FIG. 3B) are closed. The wire 21 is laid over the corner pulleys 26 and 29 serving as a first pulley and the pulley pairs 24, 25, 27, and 28 serving as a second pulley. One end portion, that is, the fixed end portion 21A, of the wire 21 is fixed to the body 11. Another end portion, that is, the free end portion 21B, of the wire 21 is attached to one end of the arm 22. Another end of the arm 22 is attached to one end of the biasing member 23 that generates a biasing force or a tensile force. Another end of the biasing member 23, which is not attached to the arm 22, is fixedly attached to the body 11.

The arm 22 is slidably held by the slide rail 22*a* in an axial direction of the wire 21. Thus, the wire 21 is pulled in the body 11 by a predetermined tensile force. The micro switch 8 faces the free end portion 21B of the wire 21 to work as an interlock switch for power supply. The micro switch 8 includes the switch lever 9 serving as a movable lever and the base 9'.

When at least one of the first cover 12, the second cover 14, the third cover 16, and the fourth cover 18 is closed, the corresponding strikers 13, 15, 17, and 19 are inserted into the body 11 through the openings 13*a*, 15*a*, 17*a*, and 19*a*, respectively, and press against the wire 21 that runs in a direction substantially perpendicular to the insertion direction of the strikers 13, 15, 17, and 19. Accordingly, a route of the wire 21 is deformed and bent by the strikers 13, 15, 17, and 19 locally at positions opposing the strikers 13, 15, 17, and 19 as illustrated in FIG. 5. The free end portion 21B of the wire 21 moves along the route of the wire 21 in accordance with a bending amount of the wire 21 caused by insertion of the strikers 13, 15, 17, and 19. Focusing attention on the movement of the free end portion 219 of the wire 21, the micro switch 8 is provided at a position facing the free end portion 21B of the wire 21.

With this configuration, when the first cover 12, the second cover 14, the third cover 16, and the fourth cover 18 are closed, the arm 22 provided on the free end portion 219 of the wire 21 moves. When the moving amount of the wire 21 reaches a predetermined amount, the arm 22 contacts the switch lever 9 of the micro switch 8, turning on the micro switch 8. Thus, the wire 21 serves as an engagement member for engaging the strikers 13, 15, 17, and 19, and the arm 22 serves as an engagement member for moving to the micro switch 8 to engage the micro switch 8.

When at least one of the first cover 12, the second cover 14, the third cover 16, and the fourth cover 18 is opened, the arm 22 is moved in a reverse direction by the biasing force of the biasing member 23. Accordingly, the arm 22 separates from the switch lever 9 of the micro switch 8. As a result, the micro switch 8 is turned off.

In the route of the wire 21, the corner pulleys 26 and 29 serving as a first pulley are provided at curving positions at which the route of the wire 21 is curved. Thus, the corner pulleys 26 and 29 provide flexibility in the layout of the route of the wire 21 in the body 11. The pulley pairs 24, 25, 27, and 28 correspond to bending of the wire 21 caused by insertion of the strikers 13, 15, 17, and 19. Consequently, the pulley pairs 24, 25, 27, and 28 guide the wire 21 bent by the inserted strikers 13, 15, 17, and 19 and provide smooth movement of the wire 21 by reducing load due to friction caused by the wire 21 moving on the route thereof.

Rotational axes of the pulley pairs 24, 25, and 27 are arranged in parallel to a direction Y in FIG. 5 so that the strikers 15 and 19 are inserted into the body 11 in a direction parallel to a direction X in FIG. 5, and the striker 13 is inserted into the body 11 in a direction parallel to a direction Z in FIG. 5. By contrast, rotational axes of the pulley pair 28 are provided in parallel to the direction Z so that the striker 17 is inserted into the body 11 in a direction parallel to the direction Y. Thus, the above-described structure, in which the strikers 13, 15, 17, and 19 press against and bend the wire 21, provides improved flexibility in the pressing direction of the strikers 13, 15, 17, and 19, resulting in improved flexibility in design of the image forming apparatus 100.

The route of the wire 21 is deformed when the wire 21 is contacted and bent by the strikers 13, 15, 17, and 19 inserted into the body 11. A relation between an amount of movement of the wire 21, that is, an amount of movement of the arm 22, due to the bending of the wire 21 and an on/off condition of the micro switch 8 is explained below.

Figure 6A:
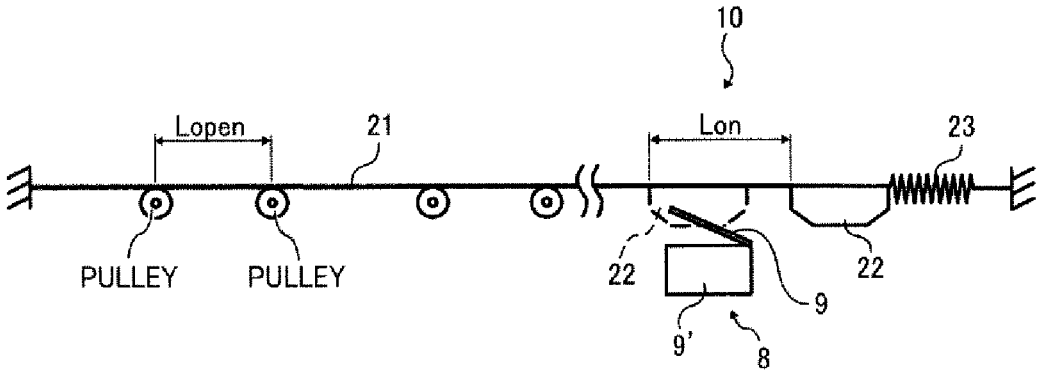
FIG. 6A is a partial schematic view of the interlock device shown in FIG. 4 for explaining operations of the interlock device.
Figure 6B:
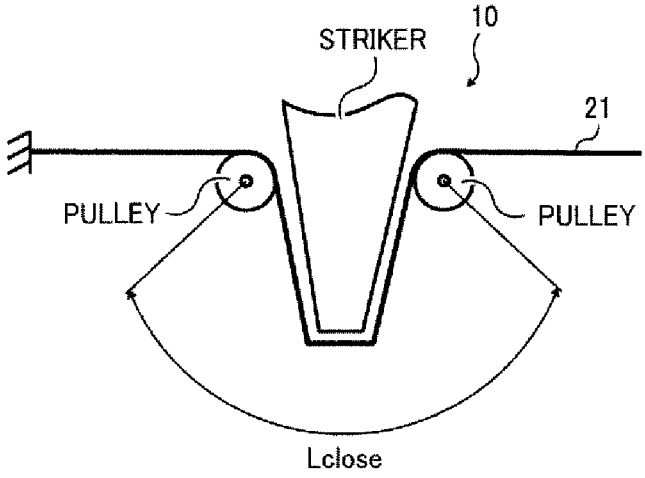
FIG. 6B is a schematic view of a pulley pair, a wire, and a striker included in the interlock device shown in FIG. 5.

FIG. 6A is a partial schematic view of the interlock device 10 for explaining operations of the interlock device 10. FIG. 6B is a schematic view of the pulley pair (e.g., the pulley pair 24, 25, 27, or 28 depicted in FIG. 5), the wire 21, and the striker (e.g., the striker 13, 15, 17, or 19 depicted in FIG. 5) included in the interlock device 10.

As illustrated in FIG. 6B, in a region defined by pulleys of the pulley pair disposed upstream and downstream from the striker in a moving direction of the wire 21, the route of the wire 21 is deformed whenever the cover (e.g., the first cover 12, the second cover 14, the third cover 16, or the fourth cover 19 depicted in FIG. 3B) is opened and closed. In other words, the route of the wire 21 is deformed whenever the striker is inserted into and removed from the body 11 depicted in FIG. 5. When a moving amount of the wire 21 is defined as ΔL, when one of the covers is closed, that is, when one striker is inserted into the body 11, the moving amount ΔL is calculated by the formula (1) below.

$$\Delta L = \text{Lclose} - \text{Lopen} \tag{1}$$

In the formula (1), Lopen is a length of the wire 21 between the pulleys of the pulley pair when the cover is opened as illustrated in FIG. 6A, and Lclose is a length of the wire 21 between the pulleys of the pulley pair when the cover is closed, that is, when the striker is inserted as illustrated in FIG. 6B. The arm 22 provided at the free end portion 21B (depicted in FIG. 4) of the wire 21 moves by the moving amount ΔL.

As illustrated in FIG. 4, when the fixed end portion 21A of the wire 21 is defined as an upstream side and the free end portion 21B of the wire 21 is defined as a downstream side, the micro switch 8 is provided at a position closer to the upstream side relative to the arm 22, and the arm 22 is provided at a position closer to the downstream side relative to the micro switch 8. A position of the arm 22 illustrated as a broken line in FIG. 6A represents a position of the arm 22 at which the arm 22 turns on the micro switch 8. A position of the arm 22 illustrated as a solid line in FIG. 6A represents a position of the arm 22 when the cover is opened, that is, when the striker does not bend the wire 21.

A distance Lon between the position of the arm 22 illustrated in the broken line and the position of the arm 22 illustrated in the solid line is calculated by the formula (2) below.

$$\text{Lon} = \Delta L \times n \tag{2}$$

In the formula (2), n is the number of strikers or pulley pairs. In this exemplary embodiment, n is four. The elements of the image forming apparatus 100 are arranged to satisfy the formula (2).

When all n covers are closed, the arm 22 moves toward the micro switch 8 to turn on the micro switch 8. By contrast, when one of the covers is opened, the arm 22 does not reach the position of the micro switch 8, and the micro switch 8 is turned off. This state is represented by the formula (3) below.

$$\text{Lon} > \Delta L \times (n-1) \tag{3}$$

Figure 7:
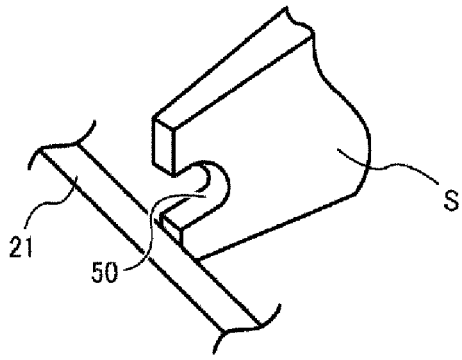
FIG. 7 is a perspective view of a variation of the striker shown in FIG. 6B.

FIG. 7 is a perspective view of a striker S as a variation of the striker 13, 15, 17, or 19 depicted in FIG. 5. As illustrated in FIG. 7, the striker S includes a U-shaped concave gutter 50.

The gutter 50 is provided at a front edge of the striker S to engage and hold the wire 21 stably. The wire 21 engages a concave portion of the gutter 50 and is guided by the gutter 50. Accordingly, when the wire 21 engages the gutter 50, the wire 21 is held by the striker S stably. Consequently, the wire 21 does not drop off the striker S due to an impact caused when the image forming apparatus 100 is dropped during transportation or when the first cover 12, the second cover 14, the third cover 16, or the fourth cover 18 is opened and closed roughly.

As illustrated in FIG. 5, the image forming apparatus 100, which is an electronic apparatus, includes the interlock device 10 that interlocks the micro switch 8 with the first cover 12, the second cover 14, the third cover 16, and the fourth cover 18 (depicted in FIG. 3B) to turn on and off the micro switch 8 for power supply in accordance with closing and opening of the first cover 12, the second cover 14, the third cover 16, and the fourth cover 18. The interlock device 10 includes the wire 21 and the arm 22 serving as an engagement member that s provided inside the body 11 and moves in a direction to turn the micro switch 8 on and off. The strikers 13, 15, 17, and 19 are provided on the first cover 12, the second cover 14, the third cover 16, and the fourth cover 18, respectively, and have a convex shape so that the strikers 13, 15, 17, and 19 are inserted into the body 11 when the first cover 12, the second cover 14, the third cover 16, and the fourth cover 18 are closed. Further, when the first cover 12, the second cover 14, the third cover 16, and the fourth cover 18 are closed, the strikers 13, 15, 17, and 19 contact the wire 21 provided inside the body 11 to cause the arm 22 provided on the wire 21 to turn on the micro switch 8. When at least one of the first cover 12, the second cover 14, the third cover 16, and the fourth cover 18 is opened, the corresponding striker 13, 15, 17, or 19 separates from the wire 21 so that the micro switch 8 is turned off. The wire 21 provided inside the body 11 is pulled by a biasing force generated by the biasing member 23 and has a predetermined length. The wire 21 runs in a direction substantially perpendicular to an insertion direction of the strikers 13, 15, 17, and 19 in which the strikers 13, 15, 17, and 19 provided on the first cover 12, the second cover 14, the third cover 16, and the fourth cover 18, respectively, are inserted into the body 11 so that the strikers 13, 15, 17, and 19 contact and press against the wire 21.

The wire 21 is laid over the pulley pairs 24, 25, 27, and 28 and the corner pulleys 26 and 29 in the body 11 by fixing one end (e.g., the fixed end portion 21A) of the wire 21 to the body 11 and setting another end (e.g., the free end portion 21B) movably. The route of the wire 21 may be deformed within a space for capturing the strikers 13, 15, 17, and 19 in accordance with a pressing amount of the strikers 13, 15, 17, and 19 pressing against the wire 21. Further, the micro switch 8 is turned on by a change of the position of the free end portion 21B of the wire 21, which is variable in accordance with the pressing amount of the strikers 13, 15, 17, and 19.

The free end portion 21B of the wire 21 is provided near the micro switch 8. Further, the arm 22 is provided on the free end portion 21B of the wire 21 so that the arm 22 turns the micro switch 8 on and off within a moving range of the free end portion 21B of the wire 21. The free end portion 21B of the wire 21 is connected to the body 11 via the biasing member 23. The switch lever 9 of the micro switch 8 returns to a position at which the switch lever 9 turns off the micro switch 8. The returning force of the switch lever 9 generates a drag force to hold the arm 22. However, the biasing force of the biasing member 23 is set greater than the drag force. Accordingly, when one of the first cover 12, the second cover 14, the third cover 16, and the fourth cover 18 is opened, the micro switch 8 is turned off immediately.

As described above, the route of the wire 21 is laid out flexibly. Specifically, the route of the wire 21 extends in a traversable line in the body 11 along the strikers 13, 15, 17, and 19 contacting the wire 21. In other words, the route of the wire 21 is variable in accordance with movement of the strikers 13, 15, 17, and 19 pressing against the wire 21. Accordingly, the interlock device 10 detects opening and closing of the first cover 12, the second cover 14, the third cover 16, and the fourth cover 18.

As described above, the micro switch 8 includes the movable switch lever 9. The micro switch 8 is turned on when the arm 22 applies pressure to the switch lever 9 and is turned off when the arm 22 separates from the switch lever 9 to release the pressure.

When n is the number of covers (e.g., the first cover 12, the second cover 14, the third cover 16, and the fourth cover 18) included in the image forming apparatus 100, and $\Delta L$ is a moving amount by which the wire 21 moves by pressure applied by one of the strikers (e.g., the strikers 13, 15, 17, and 19) provided on the covers when one of the covers is closed, the micro switch 8 is turned on when the free end portion 21B of the wire 21 is moved by a moving amount not smaller than a moving amount $\Delta L \times n$ by closing all the covers.

By contrast, the micro switch 8 is turned off when the free end portion 21B of the wire 21 moves by a moving amount not greater than a moving amount $\Delta L \times (n-1)$.

The corner pulleys 26 and 29 are provided at the corners of the image forming apparatus 100, of course, and change the direction of the route of the wire 21.

The pulley pairs 24, 25, 27, and 28 are provided at bending positions at which the strikers 13, 15, 17, and 19 deform or bend the route of the wire 21 when the strikers 13, 15, 17, and 19 are inserted into the body 11.

As illustrated in FIG. 7, the gutter 50 is provided at a front edge of the striker S to engage and hold the wire 21.

In the image forming apparatus 100 shown in FIG. 3A, the optical unit 32 and the image forming unit 33 are provided inside the body 11. Alternatively, the optical unit 32 may be provided on the first cover 12, and the image forming unit 33 including the photoconductor unit 34 that includes a photoconductor and the development unit 35 that includes a toner cartridge may be provided inside the body 11. Yet alternatively, the image forming unit 33 may be provided on the first cover 12 and the optical unit 32 may be provided inside the body 11. Yet alternatively, the development unit 35 may be provided on the first cover 12, and the optical unit 32 and the photoconductor unit 34 may be provided inside the body 11, so that the photoconductor and the toner cartridge included in the AIO (all in one) image forming unit 33 are provided separately.

In the interlock device 10 according to the above-described exemplary embodiments, opening and closing of the plurality of covers (e.g., the first cover 12, the second cover 14, the third cover 16, and the fourth cover 18) is detected by a moving amount of the wire 21 provided along the plurality of covers. Thus, the interlock device 10 has the simple structure in which detecting positions, for detecting opening and closing of the plurality of covers, and opening-closing directions, in which the plurality of covers are opened and closed, are not restricted, resulting in flexibility of design of the interlock device 10 and the image forming apparatus 100.

Further, the interlock device 10 includes the single micro switch 8 to power on and off the image forming apparatus 100. As noted previously, the micro switch 8 is turned off when at least one of the plurality of covers is opened. Further, the interlock device 10 detects opening and closing of the plurality of covers with no restriction on the order in which the plurality of covers is opened and closed. In other words, the interlock device 10 detects opening and closing of the plurality of covers even when the plurality of covers is opened and closed in any order.

In the interlock device 10, the route of the wire 21 in which the wire 21 moves is deformed without applying load to the wire 21. Thus, the interlock device 10 provides improved dynamic response to opening and closing of the plurality of covers, resulting in improved usability.

In the interlock device 10, the strikers 13, 15, 17, and 19 engage the wire 21 stably to prevent the wire 21 from dropping off the strikers 13, 15, 17, and 19. Accordingly, even when a user opens and closes the plurality of covers roughly or the image forming apparatus 100 is dropped during transportation, the interlock device 10 can continue to operate reliably.

Numerous additional modifications and variations are possible in light of the above teachings. It is therefore to be understood that, within the scope of the appended claims, the disclosure of this patent specification may be practiced otherwise than as specifically described herein.

This patent application claims priority from Japanese Patent Application No. 2009-063923, filed on Mar. 17, 2009 in the Japan Patent Office, which is hereby incorporated herein by reference in its entirety.

What is claimed is:

1. An interlock device for turning a switch on and off in accordance with closing and opening of a plurality of covers covering a body of an electronic apparatus, the interlock device comprising:

a plurality of strikers, one striker protruding from each of the plurality of covers and insertable into the body of the electronic apparatus when the cover is closed; and an engagement member engaged by the strikers and provided inside the body of the electronic apparatus to move in a predetermined direction to contact the switch to turn on the switch and separate from the switch to turn off the switch, the engagement member comprising:

a wire laid in a direction substantially perpendicular to an insertion direction of the strikers, the strikers contacting the wire when the strikers are inserted into the body of the electronic apparatus, all the strikers contacting the wire of the engagement member to turn on the switch when all the covers are closed, at least one of the strikers separating from the wire of the engagement member to turn off the switch when the corresponding cover is opened.

2. The interlock device of claim 1, wherein the wire comprises a fixed end portion fixed to the body and a free end portion opposite the fixed end portion, a route of the wire deformable by the striker through a range of movement of the striker when the striker is inserted into the body, the free end portion of the wire moving in an amount corresponding to an insertion amount of the striker to turn on the switch.

3. The interlock device of claim 2, wherein the engagement member further comprises an arm provided on the free end portion of the wire, the arm moving to and pressing against the switch to turn on the switch and separating from the switch to turn off the switch.

4. The interlock device of claim 3, further comprising a biasing member, one end of which is fixed to the body of the electronic apparatus and another end of which is connected to the free end portion of the wire to apply a biasing force to the wire.

5. The interlock device of claim 4, wherein the switch comprises a movable lever to turn on the switch when pressed by the arm and to turn off the switch when not pressed by the arm.

6. The interlock device of claim 5, wherein the biasing force of the biasing member is greater than a drag force of the movable lever to turn off the switch.

7. The interlock device of claim 1, wherein a route of the wire extends in a traversable line in the body of the electronic apparatus along the strikers contacting the wire.

8. The interlock device of claim 1, wherein the switch is turned on when the free end portion of the wire is moved by an amount not smaller than $\Delta L \times n$ when all the covers are closed, and the switch is turned off when the free end portion of the wire is moved by an amount not greater than $\Delta L \times (n-1)$, where n is the number of covers and $\Delta L$ is a moving amount in which the striker presses against and moves the wire when one of the covers is closed.

9. The interlock device of claim 1, further comprising a first pulley over which the wire is laid, the first pulley being provided on a point of a route of the wire at which a direction of the route of the wire changes.

10. The interlock device of claim 9, further comprising a second pulley over which the wire is laid, the second pulley being provided along the route of the wire at a bending position at which the route of the wire is deformed when the striker is inserted into the body and presses against the wire.

11. The interlock device of claim 1, wherein the striker comprises a gutter provided at a front edge of the striker to engage and hold the wire.

12. An image forming apparatus comprising:

the interlock device according to claim 1;

an optical unit provided on one of the plurality of covers to form a latent image; and an image forming unit provided inside the body to form the latent image into a visible image.

13. An image forming apparatus comprising:

the interlock device according to claim 1;

an optical unit provided inside the body to form a latent image; and an image forming unit provided on one of the plurality of covers to form the latent image into a visible image.

14. An image forming apparatus comprising:

the interlock device according to claim 1;

a photoconductor unit provided inside the body to bear a latent image;

an optical unit provided inside the body to form the latent image on the photoconductor unit; and a development unit provided on one of the plurality of covers to develop the latent image formed on the photoconductor unit into a visible image.

* * * * *